United States Patent [19]

Aumann et al.

[11] Patent Number: 4,512,423

[45] Date of Patent: Apr. 23, 1985

[54] CORING DEVICE WITH AN IMPROVED WEIGHTED CORE SLEEVE AND ANTI-GRIPPING COLLAR

[75] Inventors: James T. Aumann; Michael Filshtinsky, both of Salt Lake City, Utah

[73] Assignee: Christensen, Inc., Salt Lake City, Utah

[21] Appl. No.: 530,783

[22] Filed: Sep. 9, 1983

[51] Int. Cl.[3] ..... E21B 25/06

[52] U.S. Cl. ..... 175/226; 175/249

[58] Field of Search ..... 175/58, 245, 249, 226; 166/187

[56] References Cited

U.S. PATENT DOCUMENTS

| | | | |
|---|---|---|---|
| 2,927,775 | 3/1960 | Hildebrandt | 255/72 |
| 2,927,776 | 3/1960 | Hildebrandt | 175/245 X |
| 3,338,310 | 8/1967 | McGill | 166/187 X |
| 3,463,255 | 8/1969 | Martinsen | 175/249 X |

*Primary Examiner*—Stephen J. Novosad
*Assistant Examiner*—Michael Starinsky
*Attorney, Agent, or Firm*—Beehler, Pavitt, Siegemund, Jagger & Martella

[57] ABSTRACT

An improved coring device that incorporates a nonrotatable inner barrel disposed within the outer driving structure of the drill string which is coupled to a coring bit. A woven metal mesh sleeve is circumferentially mounted outside the inner barrel and tucked around its lower end. The lower end of the mesh sleeve in the inner barrel is in turn connected to a stripper tube which is pulled upwardly during the coring operation. As the core is cut by the coring bit and enters the inner barrel, the woven metal mesh sleeve is disposed about the core and constricts about the core when pulled upwardly by the stripper tube. The opposing end of the woven metal mesh sleeve is connected to a weight which serves to compress the metal sleeve when outside the inner barrel, thereby increasing its diameter to prevent binding or jamming.

15 Claims, 9 Drawing Figures

D
10
14
13
16
15
11
22
33
22
A
19
34
23
23
20
32
37
42
48
12
51
49
49
25
59
45
61
61
55
125
65
40
62
50
58
105
B
67
150
150
70
114
127
71
112
63
30
76
C
63
110
75
73

D
14
11
10
13
16
100
16
22
15
19
22
17
A
19
33
23
33
20
20
34
12
49
49
51
59
45
61
61
40
65
125
50
62
58
105
67
B
150
150
127
70
112
114
110
63
71
76
63
30
C
73
75

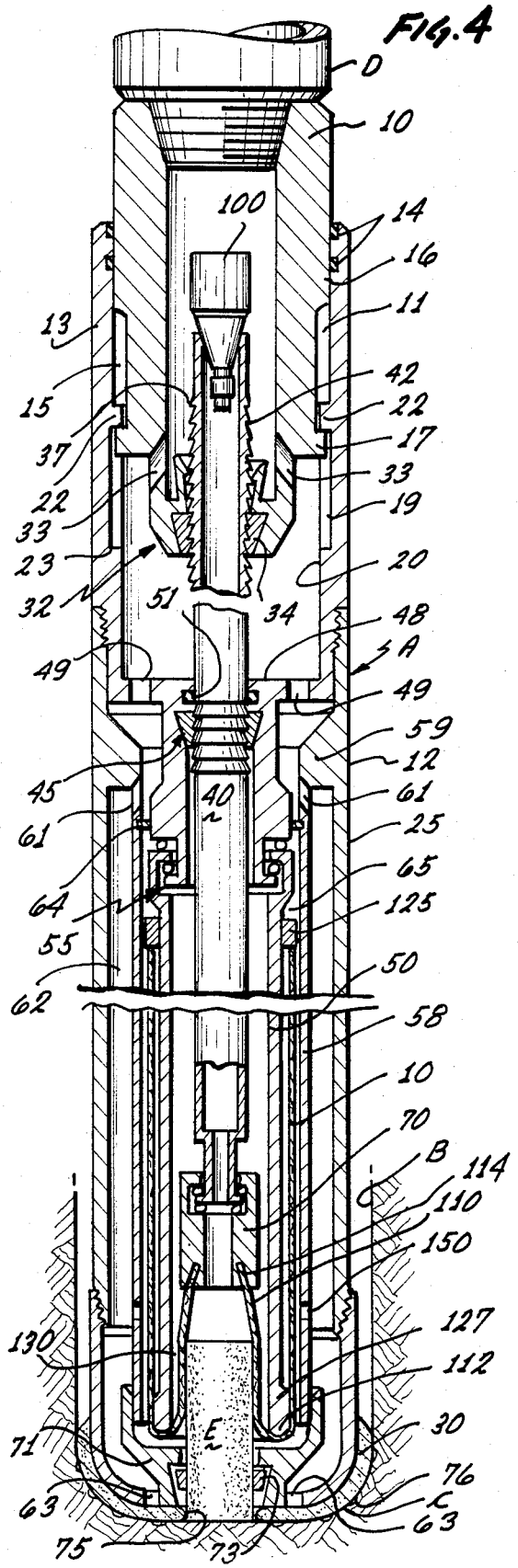
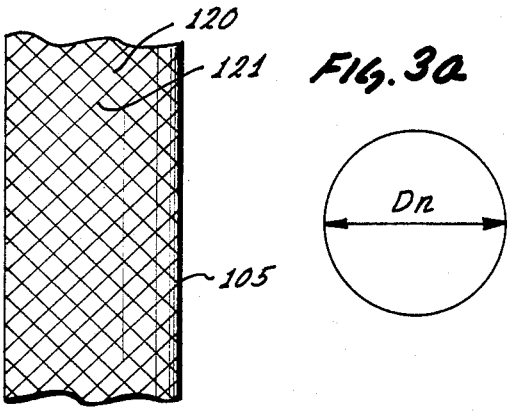
Fig. 3a
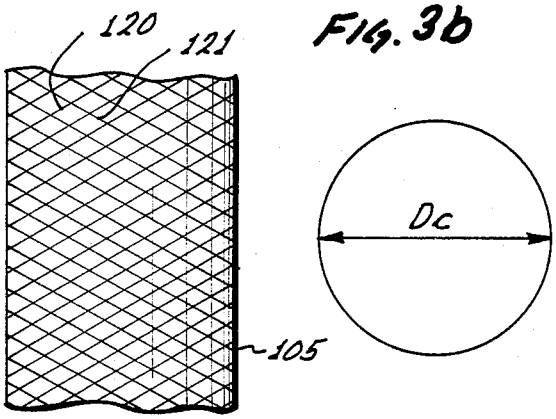
Fig. 3b
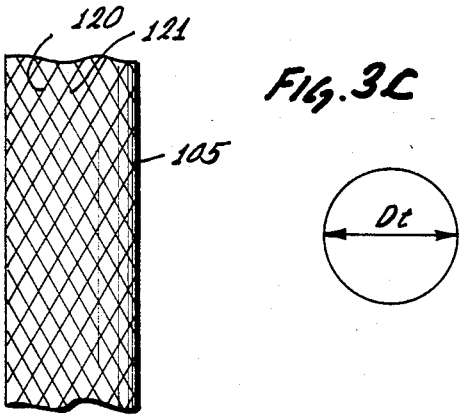
Fig. 3c 40
50
A
25
155
67
70
114
110
105
130
127
B
112
E
158
30
76
C
160

CORING DEVICE WITH AN IMPROVED WEIGHTED CORE SLEEVE AND ANTI-GRIPPING COLLAR

FIELD OF THE INVENTION

This invention relates to subsurface well bore equipment, and more particularly to an improved coring device having an improved core sleeve and antigripping collar for obtaining cores from formations in well bores.

RELATED APPLICATIONS

Reference is made to U.S. patent application Ser. No. 530,784 filed of even date herewith and assigned to the same assignee as this application.

BACKGROUND OF THE INVENTION

It is now well recognized in a variety of industries that core samples from well bores provide useful and sometimes invaluable information. Data regarding subsurface geological formations are of recognized value in drilling for petroleum and gas, mineral exploration, in the construction field, in quarrying operations, and in many other similar fields. In the petroleum and gas drilling field it is often difficult to secure proper or any cores from certain types of formations. For example, coring in soft formations, unconsolidated formations, conglomerates or badly fractured rock often results in loss of the core from the washing action of circulated drilling fluid, or in crumbling or other disturbance to the core. As a result, the recovered core is so badly damaged that standard tests for permeability, porosity and other parameters cannot be performed. In addition, cores that are recovered are very often disturbed even more in the attempt to remove them from the core barrel. In other instances, when the core has jammed within the core barrel the entire drill string must be brought out of the hole to remove the jammed core from the core barrel so that coring can resume. In addition, jamming often results in significant amounts of core being ground up under the jammed barrel and not recovered.

In the case of unconsolidated formations, it is known from U.S. Pat. No. 2,927,775 to use a rubber or equivalent elastic sleeve which grips the core as the core is cut. Also disclosed therein is a woven metal core sleeve. An elastomeric or fabric sleeve operates well for unconsolidated cores, but where the material being cored is fractured rock such as Monterey Shale and Chert, which is comprised of hard and very hard rocks, the alternation of consolidated bands with highly fractured unconsolidated sections not only limits the length of the core samples, but provides samples with very sharp edges and crushed granules and pebbles. The prior art elastomeric or fabric core sleeves do not operate well with this type of material.

A variation of the core sleeve is described in U.S. Pat. No. 3,511,324 which describes a finely meshed knitted fabric such as nylon and the like. However, in the structure described in this particular patent, the diameter of the core sleeve is not reduced and no resistance against a transverse deformation of the sample is provided. Moreover, the system described in this patent does not provide any constriction of the sleeve on exertion of a tensile load.

U.S. Pat. No. 4,156,469 also relates to a resilient sleeve which is bunched into a holder, the principal purpose of which is to reduce the coefficient of friction rather than the normal force of friction.

U.S. Pat. No. 3,363,705, like U.S. Pat. No. 3,511,324 previously discussed, does not grip or lift the core, although there is described therein a core-receiving sampling sleeve which is generally tubular in configuration and fabricated from nylon mesh.

U.S. Pat. No. 3,012,622, assigned to the present assignee, also describes a rubberlike coring retaining sleeve for retrieving a core from a bore hole. Again, equipment of the type described in this patent has operated successfully with certain soft unconsolidated formations, but provides somewhat poorer performance in the case of hard, abrasive rock such as conglomerates, or badly fractured rock.

Other patents which relate to core sleeves include U.S. Pat. No. 3,804,184 and those mentioned in the text of this application.

The coring devices and core sleeves described in the above-identified patent operate satisfactorily under many circumstances, but where the formation is comprised of hard, broken and fragmented rock, the core often jams within the coring device. Core jamming is caused by the friction produced between the core and the inner barrel of the coring device within which the core is located. The friction which tends to produce jamming is the product of two factors, one being the force pushing the materials together, and referred to as the "normal force" and the other being the "coefficient of friction" which depends upon the types of materials being pushed together and any lubricating fluid between them. Broken or fractured pieces of the core act like a wedge inside surface of the inner tube. The "normal force" is created by the angle of fracture and the force required to push the core upward to insert the core into the barrel. Eventually, this force exceeds the strength of the core or exceeds the drill string weight. In such an instance, the new core is crushed in the throat of the bit or the core jams, and drilling stops because of a lack of weight on the cutters of the bit.

In some of the prior patents previously identified, attempts have been made at reducing the "coefficient of friction" between the core and the inner tube as an attempted means to reduce jamming. In the main, such attempts have been ineffective because the "coefficient of friction" cannot be reduced to zero. Accordingly, with a doubling of forces with each fracture, jamming is postponed but not eliminated.

It has also been noted with respect to some coring devices of the prior art that the core catcher is mounted so that it is carried by and rotates with the bit. This may cause the coring device to disintegrate or grind up highly fractured core, thereby tending to increase jamming in the bit throat and catcher areas. It has also been noted with respect to the prior art devices that ground-up material sometimes enters between a gap which is normaly present between the core catcher and the associated core shoe, thus tending to cause core jams in the region between the inner tube and the core catcher.

Accordingly, it is an object of the present invention to provide a unique coring device incorporating a unique core sleeve which grips the core tightly and eliminates friction by reducing the "normal force" rather than the "coefficient of friction" and wherein a weight is used to maintain the sleeve in compression.

Another object of this invention is to provide an improved coring apparatus including a unique woven wire mesh tube which lifts the core and prevents the fracture planes of the core from sliding and acting like a wedge, thereby substantially eliminating core jams, especially with highly fractured formations, thereby insuring relatively high core recovery and wherein the core sleeve is maintained in compression by a weight which insures proper movement of the sleeve in use.

It is also an object of the present invention to provide an improved coring apparatus which includes an approved wire metal core sleeve which insures relatively high core recovery, especially when used in formations which are highly fractured, hard formations and wherein an improved system is used to maintain the sleeve in compression until tensile forces are applied thereto.

Still another object of the present invention is to provide an improved coring device which includes a unique wire core sleeve which is maintained in a compressed condition around the inner core barrel by a weight which bears against the end of the sleeve, the sleeve being fed around the lower end of the inner core barrel, wherein tension is applied to the core sleeve in the inner barrel to compress the sleeve around the core to keep the core together, and to prevent the core from touching the inside of the wall.

A further object of this invention is to provide an improved coring device including a unique core sleeve and wherein a weight cooperates with the core sleeve to maintain the latter in compressed condition between the inner core barrel and the intermediate tube, thereby permitting the core sleeve to be fed easily around the lower end of the inner core barrel.

Still a further object of the present invention is the provision of an improved coring apparatus in which a core sleeve is positioned between the inner barrel and the intermediate tube, a weight being located above the sleeve and between the tube and barrel, and wherein the intermediate tube is connected to a non-rotating inner barrel, with a core catcher connected to the intermediate tube below the core sleeve, thereby eliminating a rotating core catcher which tends to disintegrate and grind up highly fractured cores.

A still further object of the present invention is the provision of improved coring apparatus in which a core sleeve positioned between the inner barrel in the intermediate tube is maintained in compression by a weight and wherein the intermediate tube is connected to a nonrotating inner barrel. An improved core catcher is positioned inside a core shoe which is attached to a nonrotating intermediate tube. The intermediate tube includes a member which extends upwardly into the bottom of the inner barrel, but is spaced therefrom to permit movement of the core sleeve. As a result, the space between the lower end of the inner barrel and the core shoe is kept free of crushed and ground material.

BRIEF DESCRIPTION OF THE INVENTION

The above and other desirable objects are achieved in accordance with this invention by the provision of an improved subsurface coring device including a unique core sleeve of woven wire mesh. The wire mesh core sleeve is mounted on the exterior surface of an inner barrel, the latter being supported within an outer driving structure, and in spaced relationship thereto and in such a manner as to permit rotation of the driving structure with respect to the inner barrel. The wire mesh core sleeve includes a leading portion which is adapted to be positioned within the inner barrel and operates initially to receive a core as it is cut. The wire mesh core sleeve includes a leading portion which is adapted to be positioned within the inner barrel and operates initially to receive a core as it is cut. The wire mesh core sleeve has a predetermined normal diameter which is less than the diameter of the sleeve in a compressed state but greater than the diameter of the sleeve when tension is applied to the sleeve. As positioned with respect to the inner barrel, the portion of the sleeve which surrounds the inner barrel is kept in a compressed state by a weight and thus has an inside diameter greater than the outside diameter of the inner barrel while the portion of the sleeve which is positioned inside the inner barrel is in tension to grip, compress and lift the core which is received within the sleeve. The outside diameter of the sleeve, in tension, and surrounding and gripping the core, is less than the inside diameter of the inner barrel. Also, associated with the wire mesh core sleeve, are means positioned within the inner barrel and connected to the sleeve to draw the sleeve within the inner barrel, to apply tension to that portion of the sleeve which is within the inner barrel in order to encase and to grip the core as it is cut and to lift the core. In one form, the remaining structure of the coring device is structured such that it is adapted to be connected at one end to a bit for cutting a core, and at the other end to the lower end of a pipe string, the outer driving structure being in telescoping relationship and being co-rotatable with the pipe string.

In one form as described and claimed in the wire mesh core sleeve is formed in a diamond weave such that alternating bundles of wires are at substantially 90° with respect to each other and at substantially 45° with respect to the longitudinal axis of the sleeve when in a released condition. Typically, the wires are of a sufficiently small diameter to be able to make the turn from the outside to the inside of the inner barrel, and of a sufficient hardness and strength to resist being cut by the sharp edges of the hard abrasive rock, which being strong enough to lift the core and at the same time sufficiently flexible to bend around the end of the inner barrel, as described.

One of the advantages of the wire mesh core sleeve, and the associated coring structure, in accordance with the present invention, is the reduction of the core jamming caused by friction produced between the core and the inner barrel. Normally, friction is considered to be the product of the normal force of friction resulting in the core material pushing against the inside surface of the inner barrel and the coefficient of friction which depends upon the nature of the materials which are in sliding contact and any lubricating fluid between them. Where the core is of a nature which contains broken or fractured pieces, the core tends to act as a wedge against the inner barrel. The normal force, that is the force pushing the core material against the inner surface of the barrel, results from the angle of the fracture and the force required to push the core upwardly through the inner barrel. Each fracture approximately doubles, for the same angle of fracture, the frictional force which must be overcome by the new core entering the barrel. By the present invention, the woven wire mesh core sleeve tends to grip the core tightly and eliminates the friction by eliminating the normal force of the core against the inner barrel. Moreover, since the wire mesh core sleeve portion located within the inner barrel is in tension, its outside diameter, when wrapped around the core, is slightly less than the inside diameter of the inner barrel to provide, in a preferred form of the present invention, a small clearance between the outer surface of the core sleeve and the inner surface of the inner barrel. In this fashion, the wire mesh core sleeve lifts the core and prevents the fracture planes of the core from sliding and acting as a wedge with respect to the inner core barrel. This gripping action also prevents pieces of core from dropping out of the barrel as it is brought to the surface and acts as a continuous core catcher.

The wire mesh core sleeve is maintained in compressed condition, when positioned between the inner barrel and an intermediate tube, which in turn may be positioned between the outer tube and the inner barrel.

In one form compression is maintained by the bias of stitching of the woven core sleeve or by hydraulic flow in the vicinity of the core sleeve.

In a preferred form as described the upper free end of the wire mesh core sleeve includes a weight which operates to maintain the portion of the wire mesh core sleeve surrounding the inner barrel in a compressed condition such that its inside diameter is greater than the normal diameter of the sleeve. In this way, travel of the sleeve down the outside and around the bottom of the inner barrel is facilitated. In addition, the tension applied to that portion of the sleeve within the inner barrel which grips the core, will not cause contraction of that portion of the wire mesh sleeve on the outside of the inner barrel or between the outer lower end of the inner barrel and the interior thereof.

In another form, the coring apparatus of the present invention includes a core sleeve and weight, preferably as described above, with the sleeve being positioned between the inner barrel and an intermediate tube, and the intermediate tube being connected to the inner barrel such that the intermediate tube and inner barrel do not rotate. In this form, a core catcher is connected to the intermediate tube below the core sleeve and does not rotate, thereby eliminating a rotating core catcher which tends to disintegrate and grind up highly fractured cores. This form of improved core device, in accordance with this invention, offers the advantage of reducing jamming which results from the disintegration of the core in the region between the core catcher and the lower end of the inner barrel.

In yet another form of this invention, an improved core catcher is positioned inside a core shoe, the latter being attached to a non-rotating intermediate tube, the core shoe includes a member which extends upwardly into the bottom of the inner tube, but is spaced radially inwardly therefrom in order to permit the core sleeve to move around the bottom end of the inner barrel. At the same time the member prevents crushed and ground materials from entering into the space which might normally be present between the lower end of the inner barrel and the core shoe.

The present invention possesses many other advantages and has other objects, which may be made more clearly apparent from a consideration of the form in which it may be embodied. This form is shown in the drawings accompanying and forming part of this specification. It will now be described in detail, for the purpose of illustrating the general principles of the invention; but it is to be understood that such a detailed description is not to be taken in a limiting sense, since the scope of the invention is best defined by the appended claims.

BRIEF DESCRIPTION OF THE DRAWINGS

FIG. 3*a* is a diagrammatic view of a portion of a wire mesh core sleeve in accordance with the present invention in a normal diameter condition.

FIG. 3*b* is a diagrammatic view of a portion of a wire mesh core sleeve in accordance with the present invention in a compressed state.

FIG. 3*c* is a diagrammatic view of a portion of a wire mesh core sleeve in accordance with the present invention in a state of tension.

FIG. 4 is a view similar to FIG. 1 illustrating the coring apparatus of the present invention and illustrating the relative position of the parts of the apparatus as a length of core is being produced.

DETAILED DESCRIPTION

Figure 1:
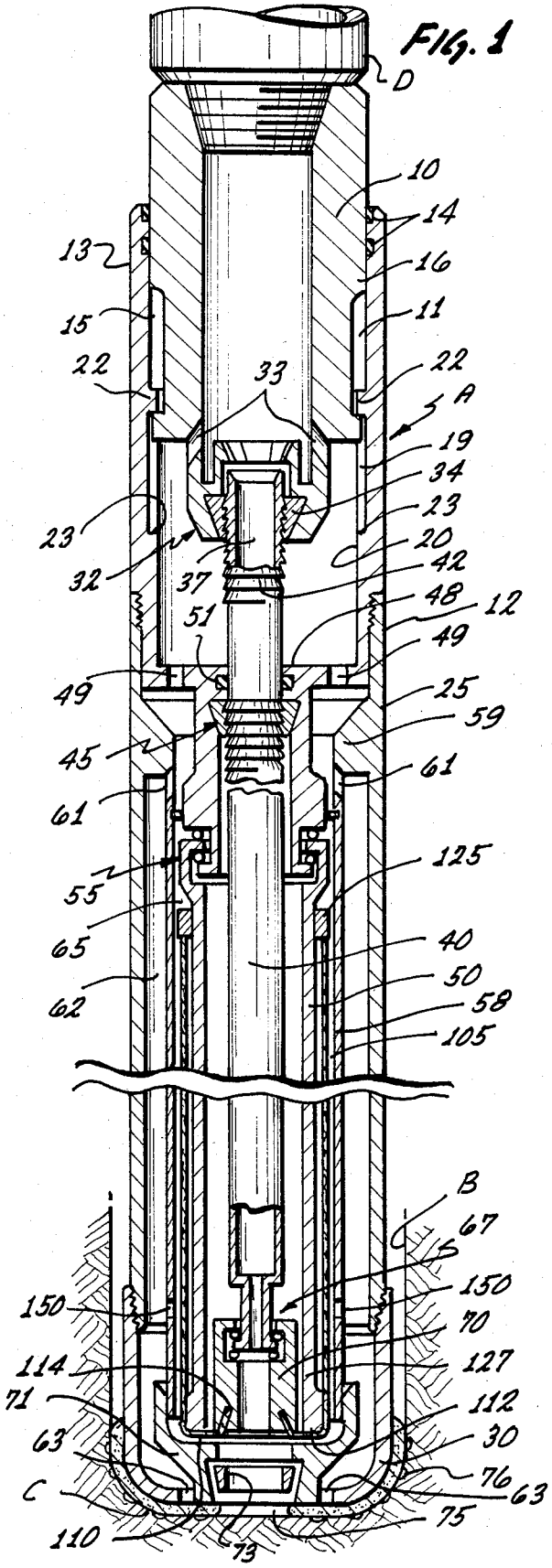
FIG. 1 is a diagrammatic longitudinal section of a coring apparatus in accordance with the present invention, with its parts in their relative position prior to the commencement of the actual coring operation.

Referring to the drawings which illustrate preferred forms of the present invention, the coring apparatus of this invention may be in the form of a coring device A adapted to be lowered into a well bore B to the bottom C by way of a string of drill pipe D, or the like. While the coring apparatus may take various forms, for the purposes of illustration, a coring device similar to that shown and described in U.S. Pat. No. 3,012,622 will be described, although it is understood that other forms of devices may be used, as will be set forth.

The lower end of the string of drill pipe may be threadably attached to the upper end of an inner mandrel 10 forming a portion of an expanding or telescopic unit 11, the inner mandrel being telescoped within the upper portion of an outer housing 12 to which it is slidably splined. The inner mandrel and the outer housing are rotated by rotation of the drill pipe in the usual manner. The outer housing includes an upper housing section 13 carrying upper and lower side seals 14 adapted slidably to seal against the periphery of the inner mandrel 10 to prevent leakage of fluid in both directions between the inner mandrel and the outer housing. The slidable splined connection includes a plurality of longitudinally and circumferentially spaced grooves 15 in the exterior of the mandrel, each of which receives a spline element 16. The lower end of the inner mandrel includes a wedge assembly 17 cooperating with a groove 19 formed in the inner wall 20 of the upper housing section 13. The lower end 22 of the splines form an upper stop at one end of the groove, while the lower end of the groove 19 including shoulder 23 forming a lower stop at the opposite end of groove 19. Threadably secured to the upper housing section 13 is an outer tube assembly 25, the lower end of which may have mounted thereon a core bit 30.

Mounted on and carried by the inner mandrel is a stripper tube latch assembly 32, with ports 33 located as illustrated for flow of fluid therethrough. Cooperating with the stripper tube latch assembly is a top stripper tube ratchet spring 34 through which passes the upper end 37 of a stripper tube 40. The stripper tube includes circumferential teeth 42 which cooperate with the latch assembly 32 and ratchet spring 34, as will be described.

Located below the upper stripper tube latch assembly is a bottom stripper tube latch assembly 45 supported by a nozzle plate 48, which may form the bottom end of the upper housing section, the nozzle plate 48 which includes a plurality of flow nozzles 49, as shown. Nozzle plate 48 also includes a seal 51 to prevent flow of fluid between the stripper tube 40 and spaced radially therefrom is an inner barrel 50, the latter spaced radially inwardly from the outer tube 12. The upper end of the inner barrel is supported by an inner barrel swivel assembly 55, as shown, a such that the inner barrel 50 does not rotate relative to the outer tube or housing 12. An intermediate tube 58 may be positioned between the inner barrel 50 and the outer tube 12, and in spaced relationship radially to each, and may be in the form of a depending tube affixed to or integral with a radially inwardly projecting shoulder 59 on the interior wall of the outer tube between the bottom stripper latch assembly 45 and the inner barrel swivel assembly 55, as shown. The upper end of the intermediate tube 59 may be provided with a plurality of flow passages 61 communicating with nozzles 49 to permit flow of fluid into the annulus 62 between the outer tube 12 and the intermediate tube 58. Fluid then flows through core bit 30, the latter provided with passages 63, to permit flow into the bottom of the well bore to remove cuttings and to convey them laterally of the bit, and to cool the bit. The fluid and cuttings then flow around the exterior of the outer tube 12 and drill pipe D to the top of the well bore.

A seal 64 may be provided between the intermediate tube 58 and the upper end of the inner barrel swivel 55, as shown, to prevent fluid flow into the annular chamber 65 formed between the intermediate tube 58 and the inner barrel 50. In the form shown, the outer tube 12 and the intermediate tube 58 rotate together, which the inner barrel 50 does not rotate with the outer tube 12. The stripper tube 40 also normally rotates with outer tube 12. The lower end of the stripper tube 40 may be provided with a stripper tube swivel assembly 67 cooperating with an anchor assembly 70 which does not rotate with the stripper tube 40 and which, like the inner barrel, is nonrotatable.

In the form illustrated in FIG. 1, the bit 30 may include a core shoe 71 which receives a core catcher 73, the latter positioned in line with a central opening 75 of the bit 30. The cut core moves upwardly through the opening 75 and through the core catcher 73 which prevents the cut core from moving downwardly out of the core shoe 71. As illustrated, bit 30 may include diamond cutting elements 76 on its lower portion and side portions for cutting the bottom of the hole and to form a core which passes upwardly, relative to bit 30 as will be described.

For further details of the structure and operation of the apparatus thus far described, reference is made to U.S. Pat. No. 3,012,622, which is representative of coring devices to which this invention relates, although it is to be understood that other forms of coring devices may be used, as will become apparent.

In general, the operation of the device thus far described, involves conditioning the well as described in U.S. Pat. No. 3,012,622. In the relative position of the parts as shown in FIG. 1, the coring device A is in the extended condition, the mandrel 10 being held upwardly by the upper stripper tube latch assembly 32 which may include a plurality of spring arms which engage the upper end of the stripper tube, as is known. Thus, rotation of the drill pipe D is transmitted through the inner mandrel 10 and through the splined connection to the outer housing to rotate the bit 30, the intermediate tube 58, the stripper tube 40, the core sleeve 71, and the core catcher 73, all of which rotate together, while the inner barrel 50 and the anchor assembly 71 do not rotate. Drilling mud or fluid is circulated as described. No core can be formed since the stipper tube 40 is fixed axially and cannot move axially since it is held by the upper stripper tube latch assembly 32, and the core cannot enter the inner barrel 50. In the form shown, the mandrel 10 may move axially about two feet with respect to the outer housing, once released, while the inner barrel 50 may have an axial length of twenty to sixty feet, for example.

Figure 2:
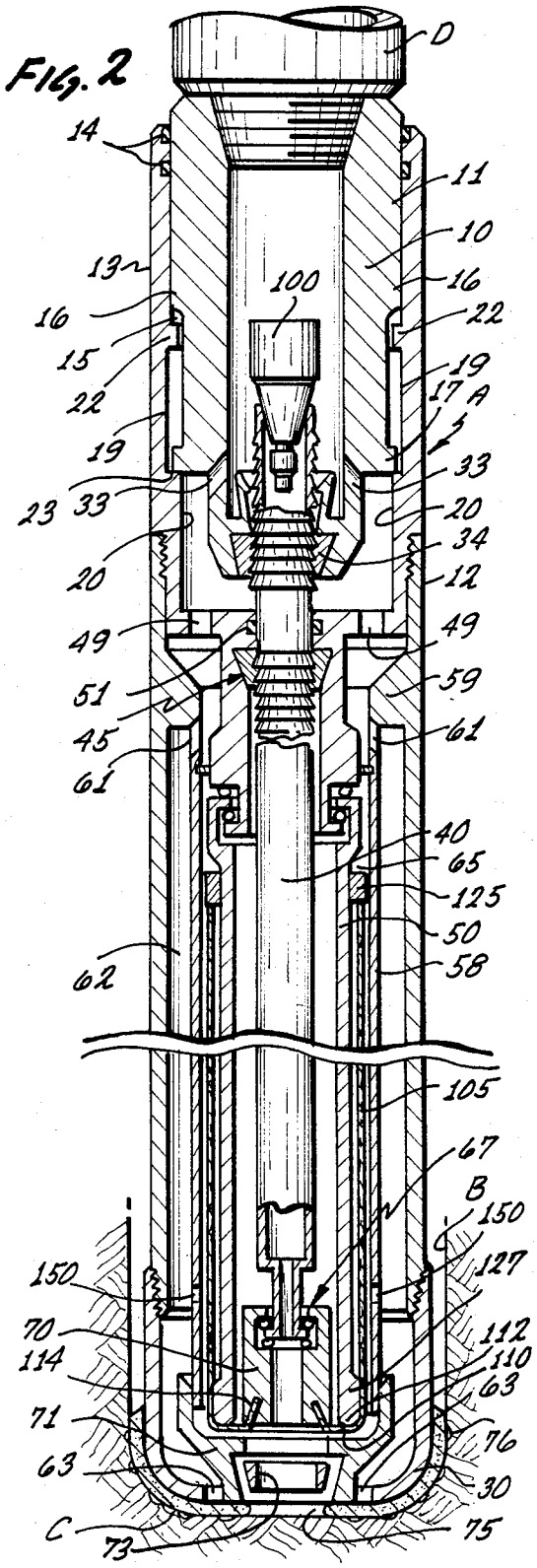
FIG. 2 is a view similar to FIG. 1, illustrating the coring apparatus of the present invention released for the commencement of a coring operation.

Coring is commenced by dropping or pumping a release plug 100 shown in FIG. 2 down through the string of drill pipes, the plug 100 passing through the mandrel 10 to release the fingers of the upper stripper tube latch assembly 32. The mandrel 10 may now move downwardly and along the stripper tube to the maximum extent, limited by the engagement of the stop ring 17 on the shoulder 23. With the release of the latch assembly 32, coring may now take place since the stripper tube 40 is no longer locked axially with respect to the outer housing, and relative downward movement of the outer tube and bit relative to the stripper tube 40 may take place, since stripper tube 40 is axially stationary with respect to the formation being cored. The above described apparatus and operation are for illustrative purposes so that the general environment of this invention may be understood.

Referring again to FIG. 1, in accordance with this invention the overall operation of coring devices of various types may be significantly improved by the use of a woven or braided wire mesh core sleeve 105 which may be mounted in surrounding relation and radially outwardly of the inner barrel 50 and radially inwardly of the outer tube 12. In one preferred form, the wire mesh core sleeve is positioned in the annular chamber 65 formed between the inner barrel 50 and the intermediate tube 58, if one is present. The wire mesh core sleeve 105 includes a leading portion 110 positioned at the open bottom end 112 of the inner barrel 50, the leading end of the mesh sleeve being secured at 114 to the anchor plate, as shown, although various other means may be used to secure the sleeve to the plate. Thus, the wire mesh core sleeve does not rotate because of the stripper tube swivel assembly 67 but is able to move axially as the stripper tube moves axially relative to the outer tube.

As shown in FIG. 3*a*, the wire mesh core sleeve is composed in one form of bundles of wires 120 and 121 in a diamond weave or braid at about 90° to each other at about 45° to the longitudinal axis of the sleeve. In a normal relaxed condition, free of compression or tension, the sleeve has a predetermined diameter which is less than the diameter of the sleeve in compression (FIG. 3*b*) and greater than the diameter of the sleeve in tension (FIG. 3*c*). Similarly, in compression the length of the sleeve is less than its normal length. The wires forming the bundles may preferably be flexible, corrosion-resistant stainless steel, for example, stainless steel 304; have a hardness sufficient to resist being cut by sharp edges of hard abrasive rock; and are strong enough to lift the core but sufficiently flexible to bend around the lower end 112 of the inner barrel. Materials with a yield strength of 25,000 lb./inch squared have been found to provide these qualities. The wire may be about 0.016 of an inch in diameter with thirteen wires to a bundle and forty-eight bundles being used. This provides a weave able to easily flex through a radius of 3/16 to ¼ of an inch, which is the typical radius at the lower end 112 of the inner barrel 50.

As seen in FIGS. 1, 2 and 4, the normal diameter of the wire mesh core sleeve is approximately equal to the diameter of the core E, and the mesh is assembled over the inner barrel 50 in a compressed condition such that the inner surface of the sleeve is spaced from the outer surface of the inner barrel 50.

Figure 5:
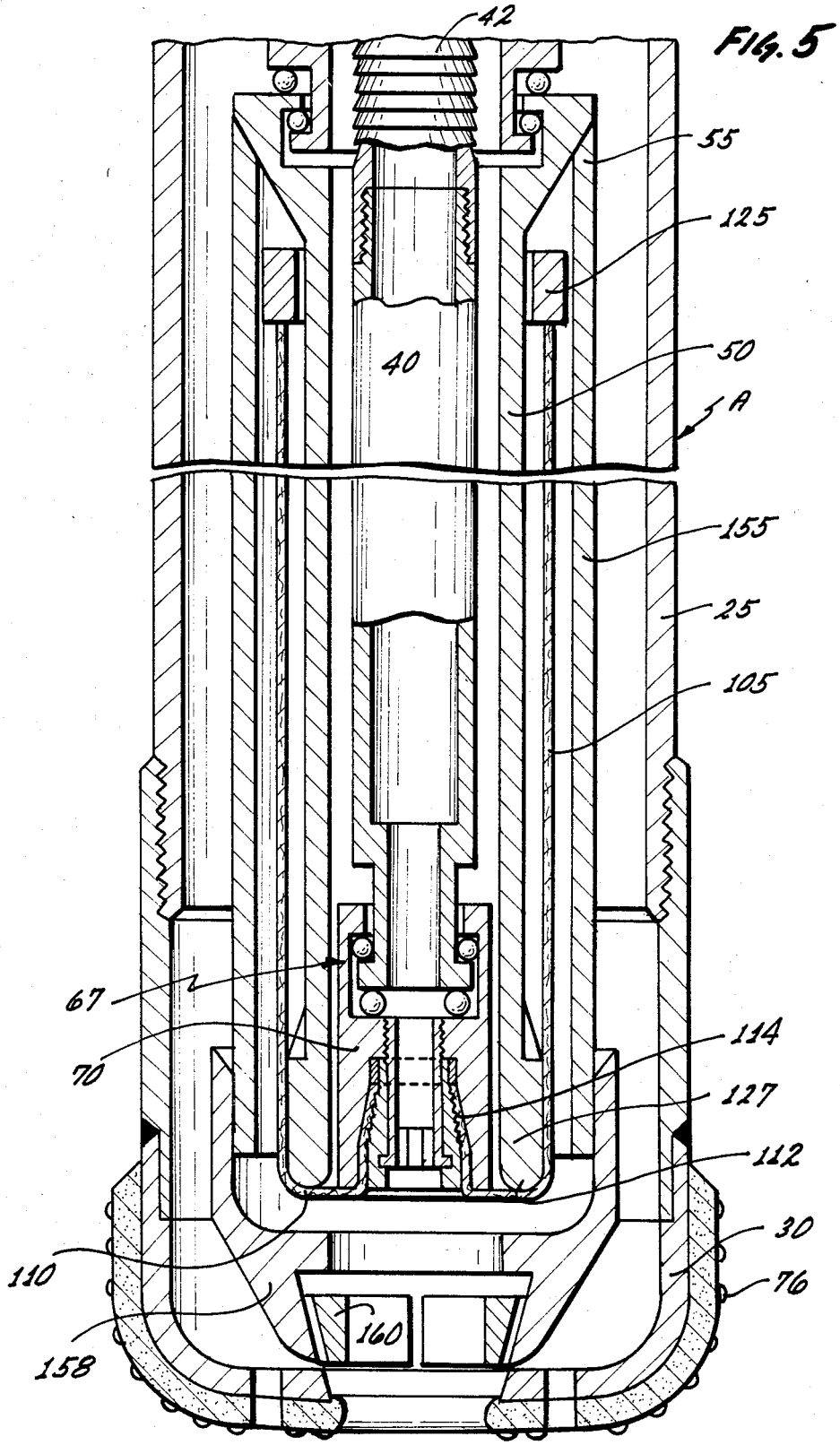
FIG. 5 is a diagrammatic longitudinal section of the lower portion of a modified coring apparatus in accordance with the present invention, with the parts thereof illustrated in their relative positions prior to the commencement of the actual coring operation.

A preferred manner of applying a compressive force to the sleeve when assembled to the inner barrel in accordance with this invention, is to provide a weight 125 on the upper end of the core sleeve as diagrammatically shown in the Figures. The weight 125 is sufficiently heavy to exert a downward force on the sleeve 105. Weight 125 freely travels down the annular space 65 until it contacts an annular shoulder 127 at the lower end 112 of the inner barrel 50. As shown in FIG. 5, the weight 125 is separate from the sleeve 105 and has an outside diameter less than the inside diameter of the intermediate tube 58 and an inside diameter greater than the outside diameter of the inner barrel 50. Thus, the weight 125 is freely movable vertically in the space 65 formed between the barrel 50 and the tube 58. In practice, the length of the annular weight 125 may be as long as four feet in order to maintain the core sleeve compressed and to bear downwardly on the sleeve 105. This downward push on the sleeve 105 significantly assists in assuring that the portion 110 of the sleeve which passes around the lower end 112 of the inner barrel 50 is not placed in tension until it enters the inside of the inner barrel 50. In other words, while the core urges the sleeve 105 downwardly and maintains that portion of the sleeve 105 which is in space 65 into compression. In this way, the tendency of the sleeve 105 to grip the outer surface of the inner barrel 50 is substantially eliminated. Thus, it is preferred to use a weight 125 which has a sufficient axial length to prevent cocking of the sleeve in the chamber. Although the weight is shown in one piece, a plurality of weights may be used, if desired.

Referring now to FIGS. 2 and 4, FIG. 2 illustrates the condition of the coring device upon release of the upper stripper tube latch assembly 32 by the stripper release plug 100, as described. The coring apparatus is rotated by the drill pipe D while fluid is pumped downwardly through it. The pressurized fluid flows through the flow path as described, and exerts a downward pressure on the core bit 30, thereby imposing proper drilling force or weight against the bottom C of the well bore. As drilling proceeds, the drill bit 30 and the outer housing 12, as well as the intermediate tube 58 and the inner barrel 50, move downwardly with respect to the stripper tube 40 and the mandrel 100. The mandrel 100 is not moved downwardly at all, but remains in the position that is had when it was first shifted downwardly within the housing, as illustrated in FIG. 2. The components surrounding the stripper tube 40 can all move downwardly, along the stripper tube 40, as permitted by the bottom stripper tube latch assembly 67. As the bit 30 forms a core E (see FIG. 4), and moves downwardly to form a hole and a core, the inner barrel 50 moves downwardly along with the bit 30 the lower end 112 of the inner barrel 50 forcing the wire mesh core sleeve 105 downwardly, assisted by the weight 125, around the lower end 112 and then upwardly into the inner open portion of the inner barrel 50. AS this takes place, a tension is applied to the core sleeve 105 within that portion thereof located within the interior or the inner barrel 50, with the result that the sleeve 105 tightly grips the core by attempting to assume the diameter which the sleeve assumes when under tension. This is illustrated in FIG. 4, where the annular clearance 130 is created between the outer surface of the sleeve 105 and the inner surface of the inner barrel 50.

One of the unique advantages of this invention is that core jamming, especially as may take place with fragmented hard abrasive rock is significantly reduced. As mentioned before, core jamming is caused by friction between the core and the inner barrel.

In situations where no elastic core sleeve or stripper tube is used, the newly cut core must push that portion of the core, which is already cut, up the core barrel. Core is essentially "lost" by a cessation of coring caused by the jam before a full core sample can be cut.

In a second situation where elastic or rubber sleeves and stripper are used, the sleeve is not strong enough to prevent the fractured core from spreading, wedging and then jamming, or sharp pieces simply sever the rubber sleeve. Elastomeric core sleeves and other equivalent core sleeves tend to grip the core due to the natural resilience of the material of which the sleeve is made. Being elastomerically resilient, any fracture in the core tends to distend or deform the elastomeric tube due to its natural resilience with the result that the fractured pieces still act as a wedge. In this case, the "normal force", which is one of the elements giving rise to friction between the core and the barrel, is created by the angle of the fracture and the force which is pulling the core upwardly into the elastomeric sleeve in the interior of the barrel 50. Each fracture approximately doubles (assuming the same angle of fracture) the frictional forces which must be overcome as new core enters the barrel. Eventually, this force will exceed the strength of the elastomeric sleeve and it is pulled in two or cut by sharp pieces of rock. The result is that the core becomes jammed as with conventional coring equipment and can fall out of the bit on the way out of the hole because the sleeve is no longer attached to the stripper tube.

The core sleeve of this invention markedly reduces the tendency to jam by tightly gripping the core with significantly greater force than is the case with elastomeric core sleeves. Moreover, since the sleeve 105 is of metal and is capable of gripping the core to provide a clearance between the sleeve 105 and inside surface of the barrel 50, jamming is markedly reduced. Another factor is that the core sleeve 105 of this invention, being affixed to a stripper tube 40, results in the tube lifting the core within the sleeve 105 since the latter grips the core tightly and has significant mechanical strength as compared to a elastomeric or equivalent core sleeve. Another factor is that the core sleeve of this invention resists being cut by the sharp pieces of broken, fractured core. In addition the wire mesh sleeve does not have simply three conditions, namely compressed, normal and tensioned, but a full range of conditions therebetween. The diameter of the sleeve, or the radial force exerted by the sleeve on the core is proportional to the amount of tension or compression exerted on the sleeve.

Moreover, the percentage of core recovery of fractured hard rock, using the wire mesh sleeve of this invention, is substantially greater than that achieved with conventional coring devices in the same formation. The average percentage of recovered core is significantly higher than has been achieved with conventional coring equipment of the prior art. It is believed that the comparatively high core recovery rate is due, at least in part, to the wire mesh sleeve 105 tightly gripping the core and, in the case of formations with many fractures, the tight gripping which results from the tension on the sleeve 105 and tends to reduce the diameter, results in the improved sleeve keeping these fractured pieces in their orignial in-situ position and keeping them from spreading or falling out of the core sleeve 105 of this invention. Even in instances of unstabilized bottom hole conditions, i.e., core barrel which is undersized with respect to bottom hole diameter, the percentage improvement in core recovery under these adverse conditions is striking.

In a sense, the improved core sleeve of this invention is nonelastic as compared to elasomer or plastic sleeves or stockinette materials as may have been described in the prior art. Even though wire metal cloths have been described, none responds to the application of a tensile force which tends to reduce the diameter of the sleeve in order to grip the core, thereby to maintain a clearance between the outer surface of the sleeve 105 and the inner wall of the inner barrel 50. Thus, even if a jam does occur, for example, in the core catcher or throat of the bit, or even if the core sleeve 105 of this invention should tear at some point along its length, the portion of the core located in that portion of the sleeve attached to the stripper tube 40 is still usually recovered because of the tension-induced tight grip of the sleeve 105 on the core, and because in the preferred embodiment, the sleeve in the relaxed state is slightly smaller than the core.

As will be apparent from the foregoing, unique advantages accrue in a coring device with the use of the improved core sleeve of the type described. It will be apparent that various modifications may be made to the foregoing described structures. More specifically, seal 64 may be eliminated to permit flow of fluid into the chamber between the inner barrel 50 and the intermediate tube 58, with fluid flow passages 150 (in dotted line) provided at the lower end of the intermediate tube 58 to permit radially outward flow of the fluid into the lower end of the chamber 62. In this way, the fluid flow forces may be used to maintain the sleeve 105 in compression by creation of hydraulic force on the weight 125.

It is also possible to improve the performance of the structure thus far described. For example, the core shoe 71 and core catcher 73 as shown in FIGS. 1, 2 and 4 are mounted to rotate with the bit 30. There are circumstances, however, in which the rotating core catcher tends to grind up highly fractured cores, resulting in jamming in the bit throat and catcher areas. To eliminate this possible source of core jamming the coring device may be modified as illustrated in FIGS. 5 and 6, in which the same reference numerals have been applied where appropriate.

Figure 6:
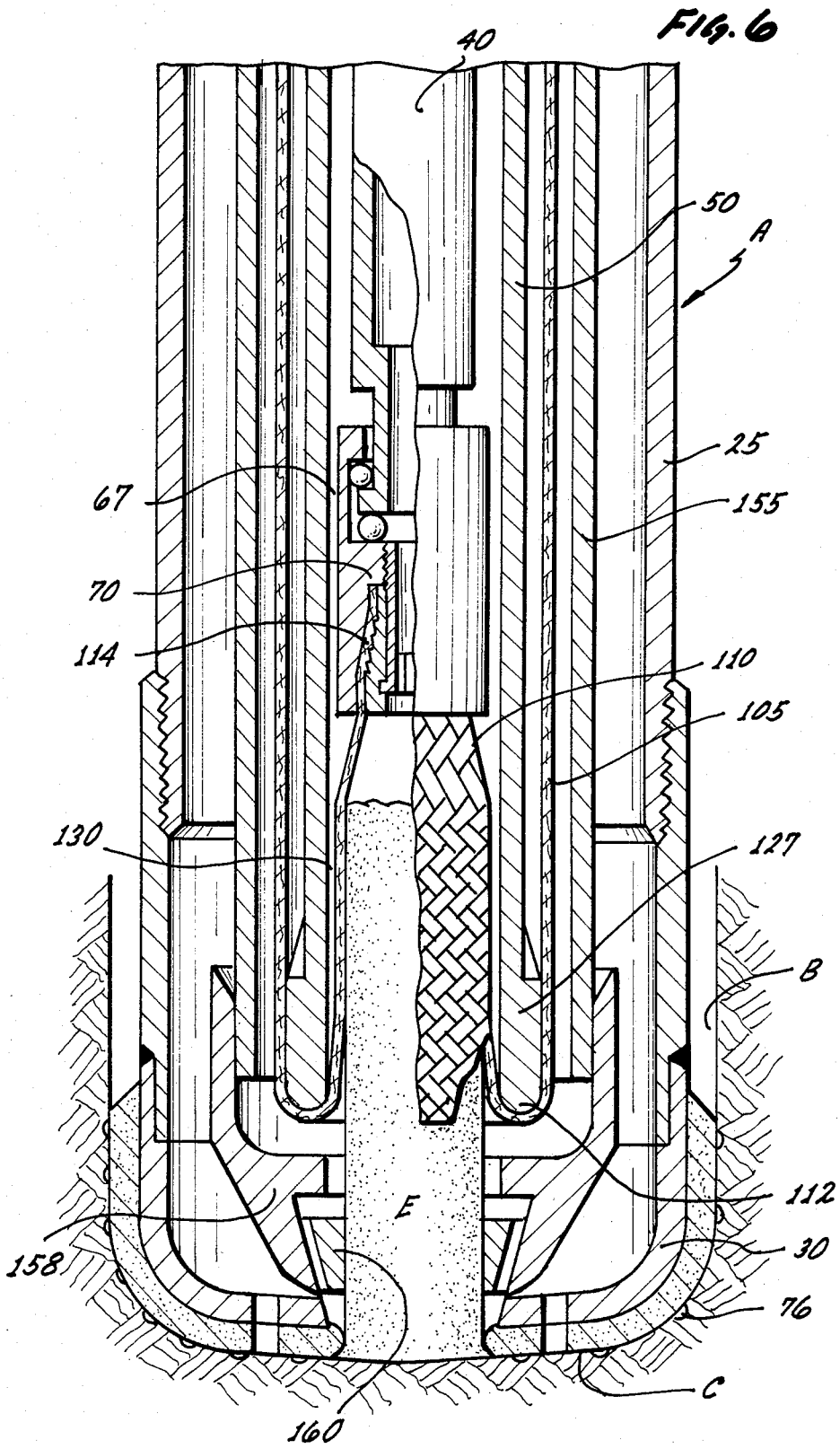
FIG. 6 is a view similar to FIG. 5 illustrating the relative position of the parts of the apparatus after a length of core has been produced.

Thus, referring to FIGS. 5 and 6, the intermediate tube 159 is affixed to the integral with the inner barrel 50 and, like the inner barrel, does not rotate with respect to the outer housing. The core shoe 158 is affixed to the intermediate tube and does not rotate, while the core catcher 160 is supported by the nonrotating core shoe and likewise does not rotate. In all other respects the structure is essentially the same as those previously described, as is apparent from FIG. 6, illustrating the relative position of the parts during coring, this Figure being similar to FIG. 3, previously described. It should be noted, however, that since neither the core shoe 158 nor the core catcher 160 rotates, the possibility of jamming resulting from rotation of the core catcher and associated parts is eliminated.

Figure 7:
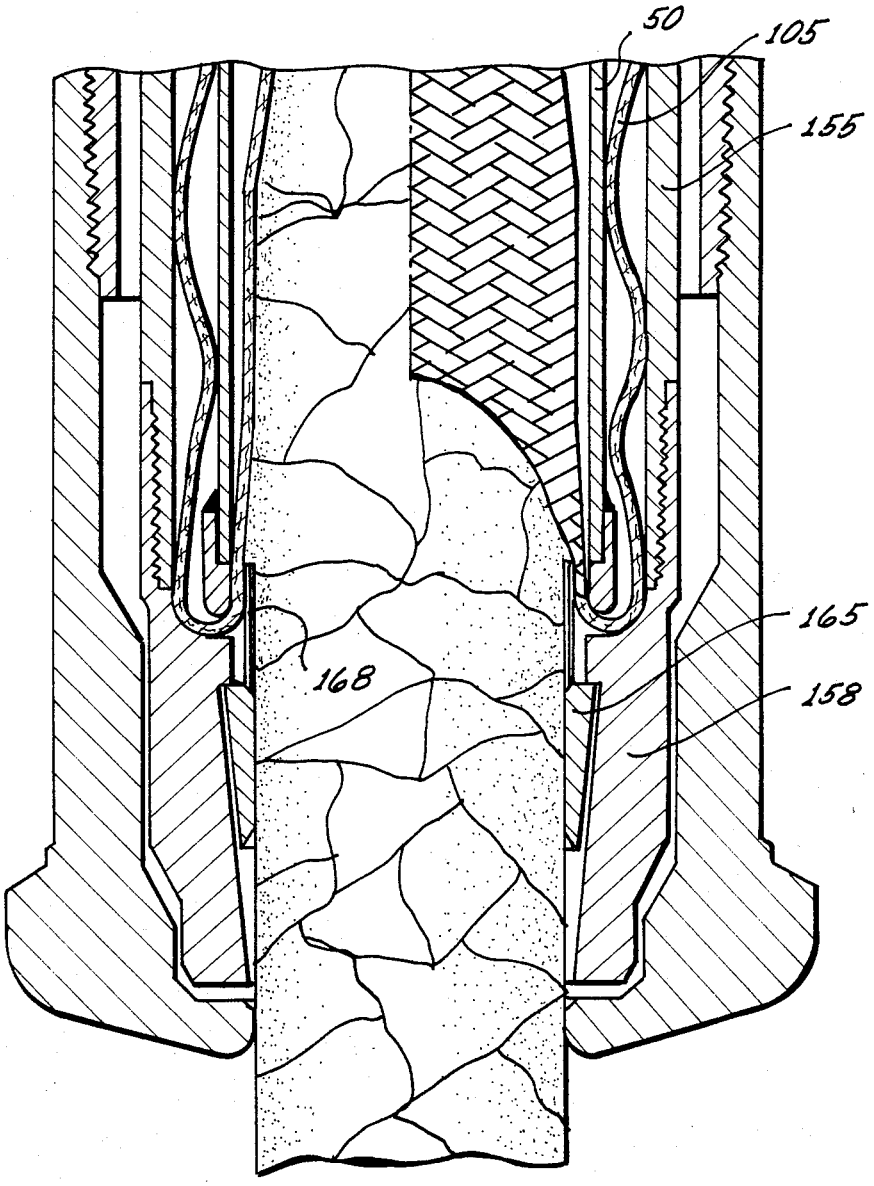
FIG. 7 is a view, again somewhat diagrammatic, along the lines of FIG. 6, illustrating a coring apparatus in accordance with the present invention and showing a modified core catcher in accordance with the present invention.

In another form of the present invention, as illustrated in FIG. 7, wherein like reference numerals have been applied where appropriate, a spring core catcher 165 is used and mounted on a nonrotating core shoe 158 which in turn is mounted on a nonrotating intermediate tube 155. In this particular form, the core catcher 165 includes an annular extension 168 which is received within that portion of the core sleeve which enters the bottom of the inner barrel 50. The annular extension is smaller in diameter than the inside diameter of the inner barrel, and sufficiently smaller than the core sleeve at the lower end of the inner barrel to permit unobstructed passage of the core sleeve. This form of core catcher has the advantage of preventing small crushed or ground rock from entering the gap between the lower end of the inner barrel and the core shoe.

The various modifications previously described may also be used with the structures shown in FIGS. 5–7, and it will also be apparent that various other modifications may be made, as will be apparent to those skilled in the art, based on the foregoing specification and described drawings, without departing from the spirit or scope of the invention as set forth in the appended claims.

What is claimed is:

1. An improved coring apparatus comprising:

an outer driving structure adapted to be connected at one end to a bit for cutting a core in a bore hole, and at the other end to the lower end of a drill string in telescoping and co-rotatable manner therewith;

an inner barrel disposed within said outer driving structure and including a lower end portion adjacent to said bit;

means supporting said inner barrel in spaced relationship to said outer driving structure while permitting rotation of said driving structure with respect to said inner barrel;

a woven metal mesh sleeve mounted in surrounding relation on at least a portion of the exterior surface of said inner barrel, said sleeve having a free end and including a leading portion adapted to be positioned within the inner barrel and initially to receive a core as it is cut;

said sleeve having a predetermined normal diameter which is greater than the diameter of the sleeve in tension;

means contacting the free end of said sleeve to maintain the portion of said sleeve which surrounds said inner barrel in axial compression, and said sleeve having an inside diameter greater than the outside diameter of said inner barrel while the portion of said sleeve positioned inside said inner barrel being in tension to grip and compress a core received within said sleeve and having an outside diameter less than the inside diameter of said inner barrel when in tension;

means positioned within said inner barrel and connected to the leading portion of said sleeve to draw said sleeve within said inner barrel and to apply tension to the portion of said sleeve within said inner barrel to encase and grip a core as it is cut; and an intermediate tube located between said inner barrel and driving structure, core shoe means carried by one end of said intermediate barrel, core catcher means supported by said core shoe, and said core catcher including an extension received within the lower end of the inner barrel.

2. An improved coring apparatus as set forth in claim 1 wherein said woven metal sleeve being mounted in the space between said intermediate tube and said driving structure; and said means maintaining said sleeve in compression being an annular weight located between said intermediate tube and inner barrel.

3. An improved coring apparatus as set forth in claim 2 wherein said intermediate tube is nonrotatable with respect to said inner barrel.

4. An improved coring apparatus as set forth in claim 2 further including core shoe means carried by said intermediate tube, and core catcher means cooperating with said core means.

5. An improved coring apparatus as set forth in claim 2 wherein said intermediate tube is connected to said inner barrel and is nonrotatable with respect thereto.

6. An improved coring apparatus as set forth in claim 2 wherein said means within said inner barrel is a stripper tube assembly.

7. An improved coring device as set forth in claim 6 wherein said stripper tube assembly includes a stripper tube swivel assembly at the lower end thereof; and means interconnecting said stripper tube swivel assembly and said woven metal sleeve to effect movement of said sleeve relative to said inner barrel.

8. An improved coring device as set forth in claim 7 wherein said sleeve includes means to maintain said sleeve in an axially compressed condition until portions of said sleeve are placed in tension.

9. An improved coring apparatus as set forth in claim 1 wherein said sleeve includes a multiplicity of strands oriented 90° to each other and 45° with respect to the longitudinal axis of the sleeve in the relaxed state; and said strands being flexible and of a hardness sufficient to prevent being cut by the edges of hard, abrasive rock.

10. An improved coring apparatus as set forth in claim 9 further including means positioned within said inner barrel and movable axially with respect thereto and attached to the portion of the sleeve positioned within said inner barrel to apply tension to the portion of said sleeve within said inner barrel.

11. An improved coring apparatus as set forth in claim 1 in which the diameter in said sleeve in said relaxed state is larger than said core.

12. An improved coring apparatus comprising:

an outer telescoping supporting structure adapted to be connected at one end to said coring bit and at the other end to a drill string;

an inner barrel supported within said supporting structure and including a lower end portion adjacent to said bit;

intermediate tube means supported by said supporting structure and spaced radially outwardly of said inner barrel to form a chamber therebetween;

sleeve means positioned in said chamber and including a free end and a portion received in the interior of said inner barrel;

said sleeve means being capable of assuming one diameter in axial compression and another smaller diameter in tension;

means located between said intermediate tube and said inner barrel contacting the free end of said sleeve to maintain the portion of said sleeve positioned in said chamber in axial compression by maintaining a diameter of said sleeve greater than the diameter of said inner barrel, the portion of said sleeve positioned within said inner barrel being in tension and having an outer diameter less than the inner diameter of said inner barrel;

said sleeve means being mounted and supported with respect to said inner barrel to grip and compress a core received by the portion of said sleeve positioned within said inner barrel as a result of the tension applied to the portion of said sleeve within said barrel; and core shoe means carried by one end of said intermediate tube, core catcher means supported by said core shoe, and said core catcher including an annular extension within the lower end of the inner barrel and received within the lower end of said sleeve to prevent cored material from entering between the lower end of the inner barrel and said core shoe.

13. An improved coring apparatus as set forth in claim 12 wherein said sleeve means includes a multiplicity of strands oriented substantially 90° to each other and substantially 45° with respect to the longitudinal axis of the sleeve in the relaxed state;

said strands being flexible and of a hardness sufficient to prevent being cut by the edges of hard abrasive rock; and said means contacting the free end of said sleeve being an annular weight positioned in said chamber.

14. An improved coring apparatus as set forth in claim 13 further including means positioned within said inner barrel and movable axially with respect thereto and attached to said portion of said sleeve means positioned within said inner barrel to apply tension to the portion of said sleeve means within said inner barrel;

15. An improved coring apparatus as set forth in claim 14 wherein said intermediate tube is affixed to said inner barrel.

* * * * *